United States Patent [19]

Daikeler et al.

[11] 4,014,481

[45] Mar. 29, 1977

[54] TOWED CRAFT FOR REPRESENTING AERIAL TARGETS

[75] Inventors: Wolfgang Daikeler, Friedrichshafen; Klaus Uwe Exner, Immenstaad, both of Germany

[73] Assignee: Dornier GmbH, Germany

[22] Filed: July 11, 1975

[21] Appl. No.: 595,111

[30] Foreign Application Priority Data

Sept. 26, 1974 Germany ..... 2445938

[52] U.S. Cl. ..... 244/3; 244/42 D; 244/90 A; 273/105.3

[51] Int. Cl.[2] ..... B64C 13/28; F41J 9/10

[58] Field of Search ..... 244/3, 42 D, 90 R, 90 A, 244/3.21, 3.24, 3.1, 1 TD, 16, 45 R, 77 E, 179; 273/105.3; 40/215; 46/76 R, 78

[56] References Cited

UNITED STATES PATENTS

| | | | |
|---|---|---|---|
| 2,440,737 | 5/1948 | Cawein | 273/105.3 X |
| 2,768,801 | 10/1956 | Bitner et al. | 244/42 D X |
| 3,064,930 | 11/1962 | Chevalier | 244/90 R X |

*Primary Examiner*—Stephen G. Kunin
*Assistant Examiner*—Barry L. Kelmachter
*Attorney, Agent, or Firm*—James E. Bryan

[57] ABSTRACT

A target aircraft adapted to be towed by an airplane, comprising a fuselage, a tail assembly, two pairs of wings mounted on the fuselage in a cross-like configuration, spoilers mounted in each of the wings, and electromagnets for actuating the spoilers.

1 Claim, 3 Drawing Figures

TOWED CRAFT FOR REPRESENTING AERIAL TARGETS

Figure 1:
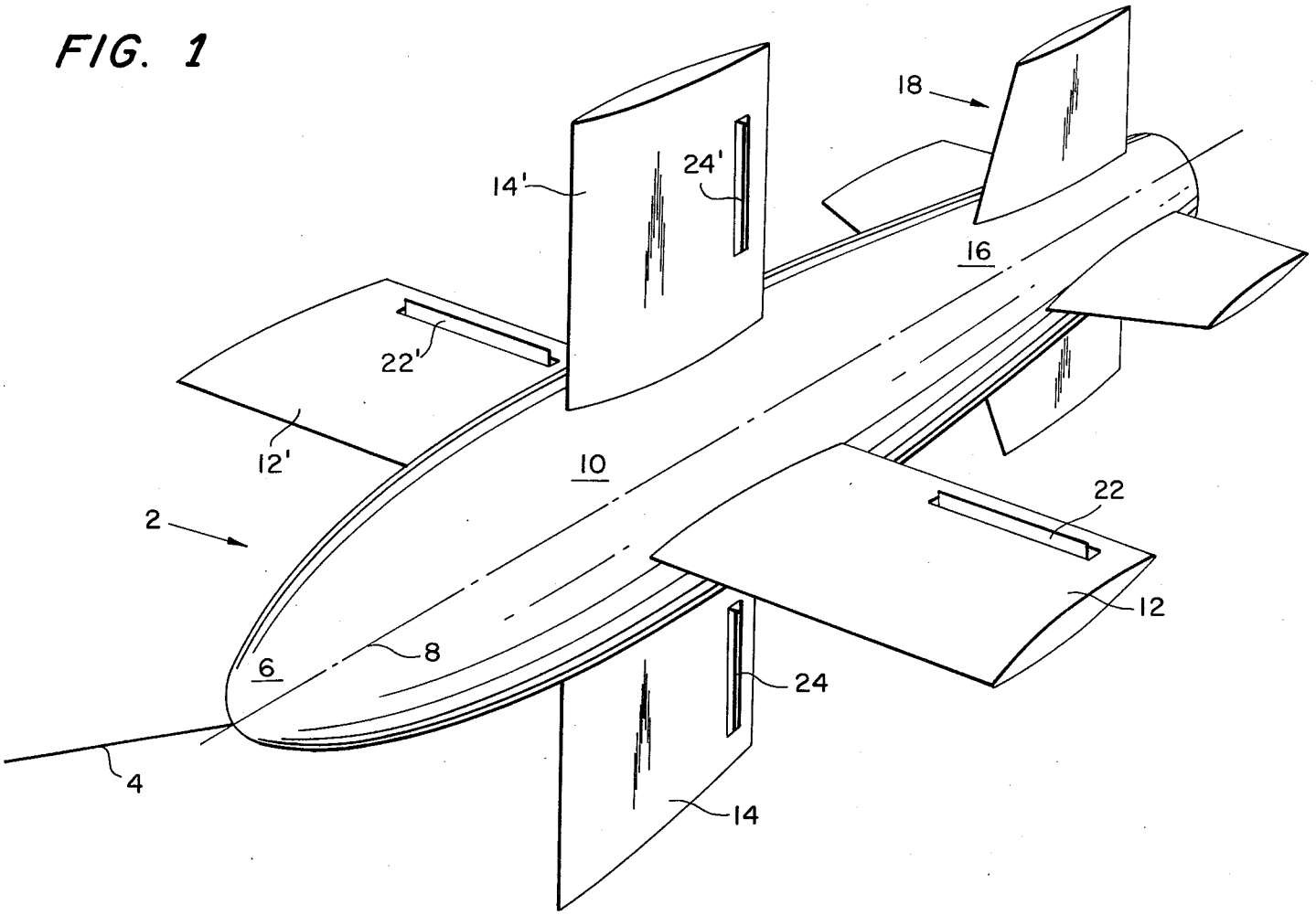

The present invention relates to an aircraft towed by an airplane, which aircraft is used for training in firing and for weapons testing, and is secured to the towing cable in a manner such as to be free from rolling moments about its rolling axis.

Known in the art are towed targets which are rigid flow bodies. Their use with manned towing airplanes permits the representation of targets on extended or elongated flight paths only because of the long towing cables required for safety reasons. The representation of flying patterns or flight maneuvers involving a high degree of maneuverability is possible with these towed targets only with short towing cables and, for safety reasons, behind unmanned towing airplanes. In both cases, the line of flight of the towed target is influenced only indirectly by way of the control of the towing airplane.

Further known in the art from German Pat. No. 614,036, is an air train in which balloons are employed as towed craft, which balloons are equipped with auxiliary drives and control devices. The balloons serve for transporting loads or passengers; it has not been considered that they be employed as towed craft for representing aerial targets for training in firing.

It is the object of the present invention to provide a towed craft which, when used with a manned towing airplane, is adapted to represent, on a long towing cable, flying patterns or flight maneuvers deviating from the main trajectory and having a high degree of maneuverability.

This object is obtained, in accordance with the present invention, by means of two pairs of lifting surfaces or wings arranged in a cross-like manner on the towed craft, in which spoilers are mounted producing lifting power, which latter are actuatable by means of electromagnets and, when the electromagnets are not excited, will return to the initial position thereof. With the aid of these structural elements producing lift it is possible for the towed craft to execute movements in a plane transverse to the main flying direction. Hence it is possible to simulate flying maneuvers of attacking combat planes by target craft in tow behind manned airplanes, in a manner suitable or appropriate for the target representation. Sharpshooting training with manned airplanes no longer must be effected at targets whose flight path course is extrapolatable, but now can be on targets which execute changes of their trajectory which are unexpected by the gunners, and therefore require of the gunners a high degree of attention, quick reactions, and safety in handling weapons to an extent which largely duplicates actual combat conditions.

The long tow length for the towed craft required in the case of the "manned" target representation, for safety of the towing airplanes, here has the desirable advantage that the freedom of movement of the controlled towed craft increases within certain limits, in a plane transverse to the main towing direction, with the length of the towing cable.

In another advantageous embodiment of the present invention, the spoilers mounted in the two cross-like arranged pairs of lifting surfaces or wings are pivotal in pairs by means of electromagnets. It is further advantageous that the spoilers are pivotal independently of each other toward both sides of the lifting surfaces or wings. This may take place in the same direction for producing movement in the transverse plane, or in the opposite direction for damping and stabilizing rolling movements.

Yet a further advantageous embodiment of the present invention is the use of a computer in the towed craft which computer receives control signals from a command post outside of the towed craft, and reference signals from a sensor within the towed craft for determining the rolling degree, and determines from both signal values which spoilers must be actuated at what keying ratio. The deflections of the spoilers pulsate and have a constant value. While the rolling degree and damping of the rolling movement is controlled, for example, on board by a reference signal picked up by a gyroscope, merely the movement of the towed craft in the transverse planes with respect to the main flying direction is effected from the command post. The computer present in the towed craft processes the signals in such a manner that the desired flight maneuvers are precisely executed.

It is possible, according to the present invention, that two oppositely actuatable spoilers could be arranged in at least one pair of lifting surfaces or wings which, for purposes of damping rolling movements and for stabilizing the rolling degree, receive reference signals from a sensor in the towed craft, and that provided at the rear end of the lifting surface pairs or wings are continuously displaceable trailing edge flaps which are actuatable for producing movements of the towed craft in the transverse plane from a command post outside of the towed craft. In this case, for example a gyroscope together with the spoilers movable by means of electromagnets form an autonomous on-board system which effects the constancy of the rolling degree and damping of rolling movements. In an advantageous manner the spoilers at one pair of lifting surfaces or wings deflect in opposite directions, whereas the trailing edge flaps which are actuatable from a command post outside of the towed craft deflect in pairs and in the same direction, and hence render possible a movement of the towed craft in planes transverse to the main flying direction.

Figure 2:
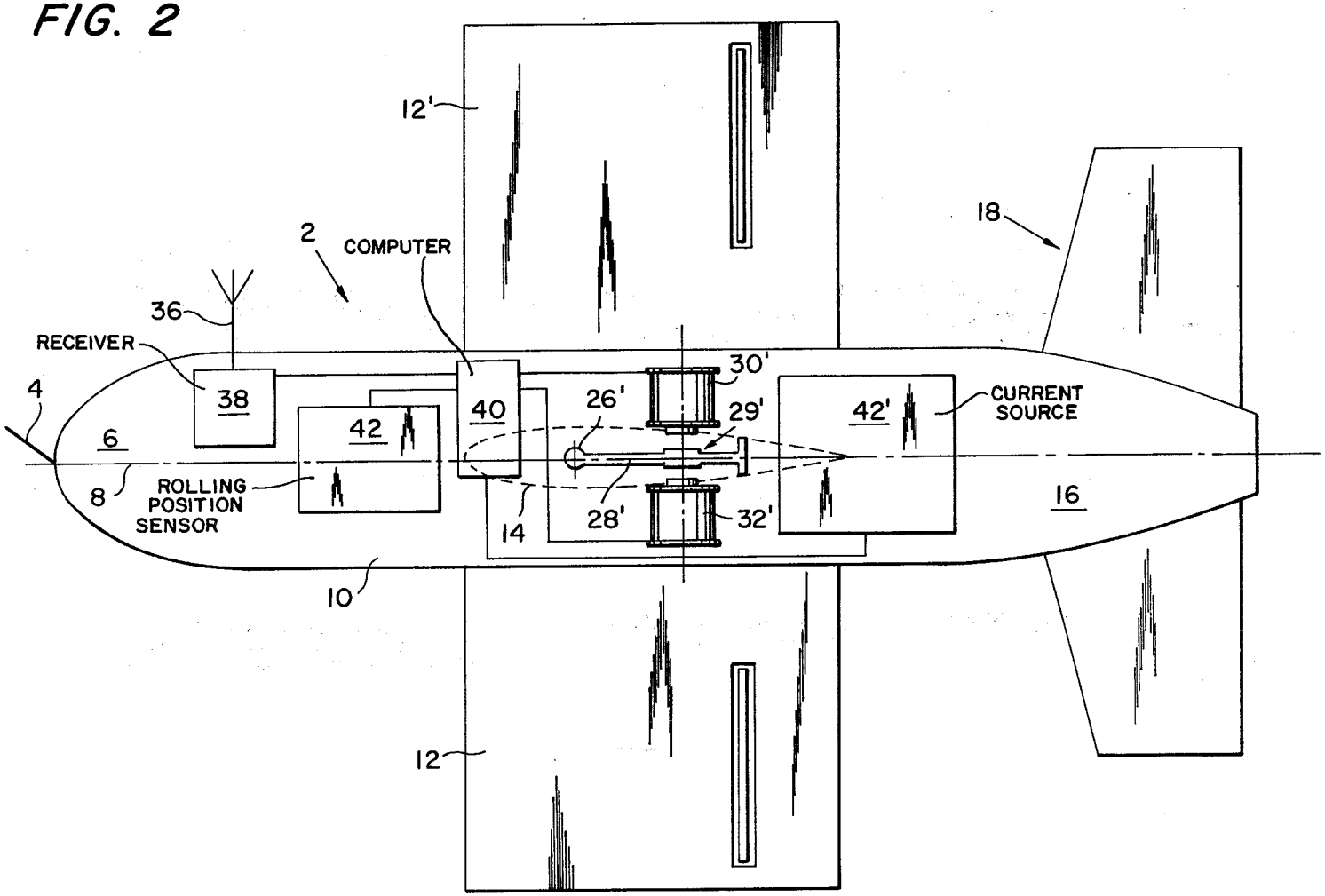
Figure 3:
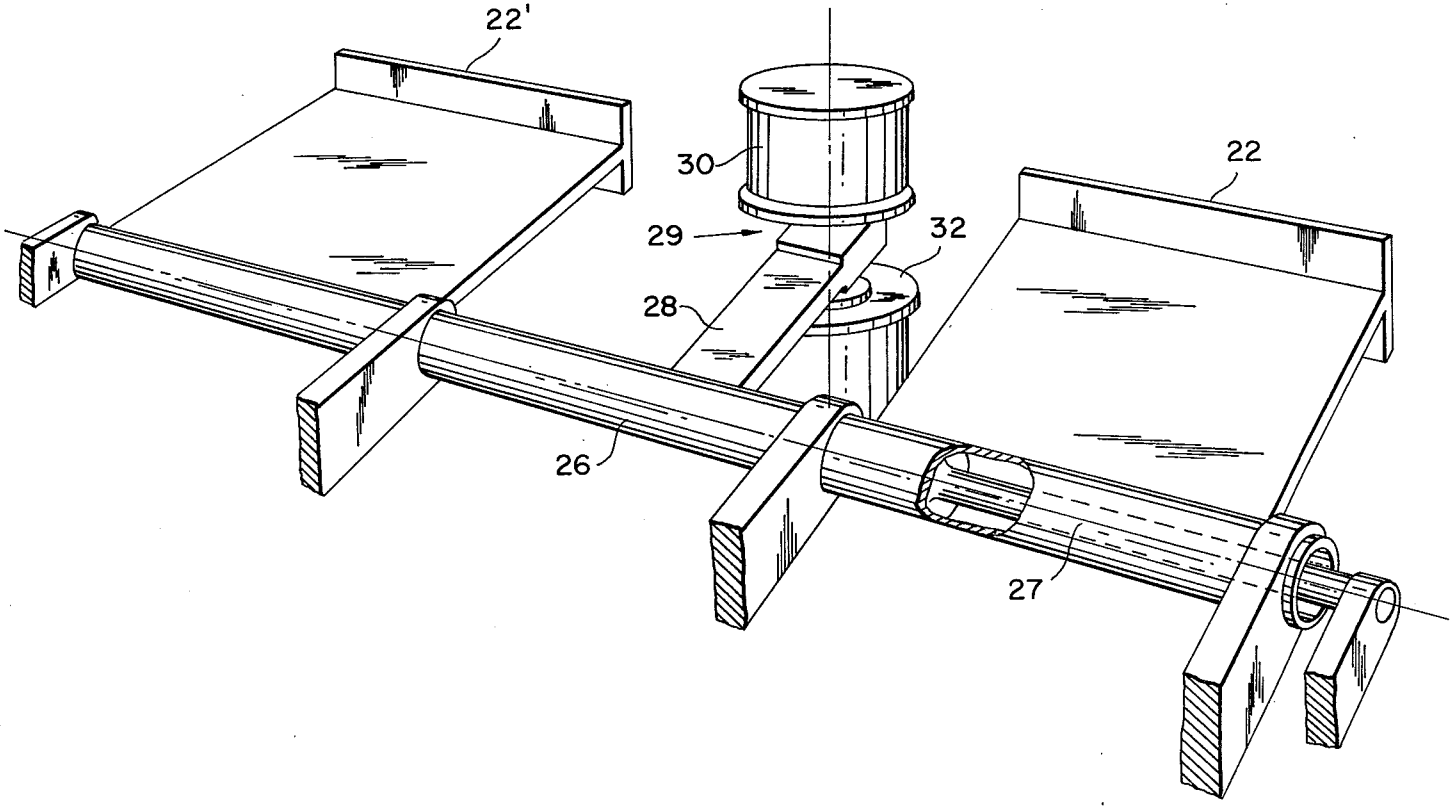

Further advantages, features and possibilities of application of the present invention will become apparent from the following description of the accompanying drawings, wherein FIG. 1 is an axonometric illustration of the towed craft of the invention, FIG. 2 is a view in cross-section of the craft of FIG. 1, and FIG. 3 illustrates the control of the spoilers by means of excitable magnets.

FIG. 1 illustrates a towed craft 2 which is towed by a towing cable 4, and an airplane (not shown). The towing cable 4 is connected at the nose 6 of the towed craft in the rolling axis 8. Mounted at the fuselage 10 of the towed craft 2 are, in pairs and in a cross-like manner, lifting surfaces or wings 12 and 12', and 14 and 14'. At the tail 16 of the towed craft 2 is a rigid tail unit 18.

In the lifting surfaces of the pairs of lifting surfaces or wings 12 and 12' and 14 and 14' are the spoilers 22 and 22' and 24 and 24'. The spoilers 22 and 22', and 24 and 24' are connected with each other each by means of a torsion rod 26 (FIG. 3). Rididly secured to this rod 26 is a lever 28 whose end 29 is positioned between two electromagnets 30 and 32. When the electromagnet 30 or the electromagnet 32 is excited, the spoilers 22 and 22′ move downwardly or upwardly from the lifting surfaces or wings 12 and 12′. If the electromagnets are currentless, the torsion rod 26 - and therewith also the spoilers 22 and 22′ - will return to the initial position thereof. The control of the spoilers 24 and 24′ is effected in an analogous manner. This is shown in FIG. 2 wherein the electromagnets have reference numerals 30′ and 32′, the torsion rod is defined with reference numeral 26′, and the lever with reference numeral 28′. Present in the bore of the torsion rod 26′ is a torsion bar 27 which effects the resetting of the spoilers into the neutral position thereof.

By means of the spoilers 22 and 22′, and 24 and 24′, the towed craft 2 executes random movements in the planes transverse to the main flying direction. The control commands for these movements are transmitted by a command post (not shown) and received by an antenna 36. A receiver 38 connected to the antenna 36 transmits the signals to a computing amplifier 40. It is here that signal values also arrive from a rolling position sensor 42 which determines the respective rolling degree of the towed craft 2, for example by means of a gyroscope (not shown). Determined in the computer 40 from both signals are signal values which actuate the spoilers 22 and 22′, and/or 24 and 24′ for a specific period of time by means of the electromagnets 30 and 32, or 30′ and 32′. For the supply of energy to the receiver 38, the computer 40, and the magnets is the current source 42′.

It is apparent from the figures that the spoilers 22 and 22′, and 24 and 24′, in the neutral position thereof can assume in each case only quite discrete deflected positions above or below the lifting surfaces or wings 12 and 12′, and 14 and 14′. The transverse movement of the towed craft 2 which deviates from the main flying direction is determined by the extent of the spoiler deflection.

If no signals are transmitted from the command post to the receiver 38, the rolling degree sensor 42 alone actuates the spoilers 22 and 22′, and 24 and 24′ in such a manner that no rolling movement will occur, or else that initiated rolling movements are damped.

It will be obvious to those skilled in the art that many modifications may be made within the scope of the present invention without departing from the spirit thereof, and the invention includes all such modifications.

What is claimed is:

1. A target aircraft adapted to be towed by an airplane, comprising a fuselage, means for connecting a towing cable to the nose of said fuselage in the rolling axis thereof, a tail assembly, two pairs of wings mounted on said fuselage in a cross-like configuration, a pair of spoiler means mounted in each pair of wings on hollow shaft means, lever means connected to said hollow shaft means and having a free end thereof positioned between two electromagnet means, and said hollow shaft means being connected with torsion rod means positioned inside said hollow shaft means, whereby said spoiler means return to an initial position thereof when said electromagnet means are currentless.

* * * * *